US008835733B2

(12) United States Patent
Boulet

(10) Patent No.: US 8,835,733 B2
(45) Date of Patent: Sep. 16, 2014

(54) FRAME CAJON

(75) Inventor: John Saussy Boulet, Silver Spring, MD (US)

(73) Assignee: John Saussy Boulet, Silver Spring, MD (US)

( * ) Notice: Subject to any disclaimer, the term of this patent is extended or adjusted under 35 U.S.C. 154(b) by 208 days.

(21) Appl. No.: 13/446,259

(22) Filed: Apr. 13, 2012

(65) Prior Publication Data

US 2013/0269502 A1 Oct. 17, 2013

(51) Int. Cl.
*G10D 13/02* (2006.01)

(52) U.S. Cl.
USPC ..... 84/411 R

(58) Field of Classification Search
USPC ..... 84/411 R, 421
See application file for complete search history.

(56) References Cited

U.S. PATENT DOCUMENTS 7,928,303 B2 * 4/2011 Millender et al. ..... 84/411 R
8,115,088 B2 * 2/2012 Herrera ..... 84/411 R

OTHER PUBLICATIONS http://web.archive.org/web/20110623194740/http:/www.americanmusical.com/Item—i-PEA-PBC512TF-LIST; Jun. 23, 2011.*

* cited by examiner

*Primary Examiner* — Kimberly Lockett

(57) ABSTRACT

This invention relates to a musical instrument, specifically a frame cajon comprising a cuboid frame with structural surfaces on the top and bottom that completely support the weight of the player allowing multiple playable sides to be attached for the percussionist. Two of the sides are further partitioned to produce a high and low pitched tone. Where a raspier tone is desired, snare wires are strung vertically between top and bottom horizontal members of the frame. The vertical members on each side of the snares are slightly concave to gently engage the snares with the playing surface. One side has a 16" drum head mounted for playing, resonance, and tuning the cajon. The cajon is raised a minimum of two and a half inches on casters or by other means to acoustically decouple the cajon from the floor to improve tone and clarity.

3 Claims, 4 Drawing Sheets

FRAME CAJON

BACKGROUND OF THE INVENTION

The present invention relates to an improved version of the cajon drum. The cajon comes from percussion traditions in Cuba and Peru. The instrument evolved from the striking of different size box containers to produce varying tones to the specific construction of boxes with features that produce an improved sound. Generally, cajons have one side that is a striking surface. The remaining sides, top and bottom of the cajon serve as structural support for holding up the player. Generally the striking surface has a snare device attached to it permanently or in a fashion that allows the player to disengage the snare with a "throw off". When guitar strings are used as the snare device, the strings often rattle uncontrollably. The strings are often taped to the striking surface from inside the box to tame the snares. In this fashion the snares are dampened but don't produce as much snare tone overall. The cajon generally sits on the floor or is raised minimally by rubber feet. Players sometimes lean back the cajon lifting the front face to achieve a clearer tone. Compared to membranophones like snares, toms and kick drums, the cajon is a dry, non-resonant instrument with little sustain because it is made from plywood. The panel directly across from the striking head is generally made of structural plywood and has a round sound opening or bass port in the middle. This opening generally faces away from the audience since the striking face is opposite. Two basic tones are generally produced from the traditional cajon: a bass tone from the middle of the striking surface and a snare tone from the corner of the striking surface.

REFERENCES

How to Build Flamenco Cajon with Plywood, German Ocana .COPYRGT. 2004

BRIEF SUMMARY OF THE INVENTION

The object of this invention is to provide new and useful improvements for achieving clearer and more varied tones from the cajon. The invention uses a large rectangular frame-based construction that allows all sides of the drum to be fitted with thin, non-structural playing surfaces while supporting all of the weight of the player. Two sides are further divided to produce a low and high frequency. The high frequency panels and the small side opposite the sound opening are enhanced with snare mechanisms. The snare dampening mechanism is built into the frame by slightly concaving the vertical frame elements to which the striking surface is attached. This snare control strategy allows the striking surfaces to gently engage the snares without rattle or tape such that the snares are excited when a snared striking surface is struck but not when a surface without snares is struck. The invention places the cajon on casters that raise the instrument off the floor a minimum of two and a half inches resulting in increased mobility and an acoustic decoupling from the floor which delivers clearer sound production. A sixteen inch tom head is mounted on one side of the cajon servings as a playing surface, a resonant head, and a tuning mechanism for the cajon. The head can be tuned to reinforce resonant frequencies of other striking surfaces, in particular that of the larger bass surface, or to reinforce harmonics. The head can be changed to induce more or less resonance. A rectangular bass port at the bottom of a small side of the cajon allows the top portion of that side to be configured as higher pitched striking surfaces. While playing this side solo or in concert with other sides, the sound opening can face the audience for greater projection.

DETAILED DESCRIPTION OF THE INVENTION

Figure 1:
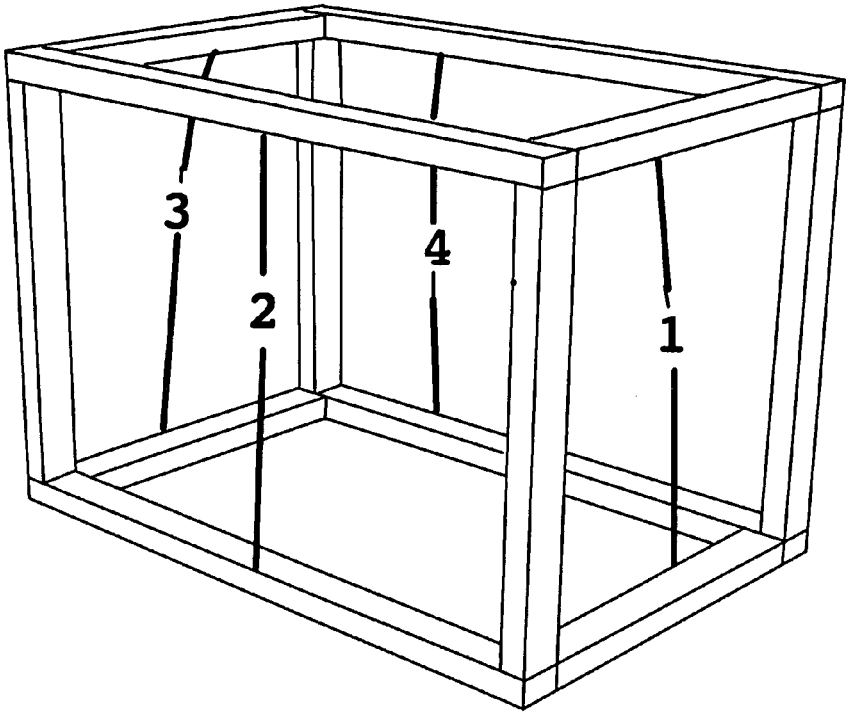
FIG. 1 is a view of the basic frame used to build a frame cajon with numbering for the four sides of the cajon.
Figure 2:
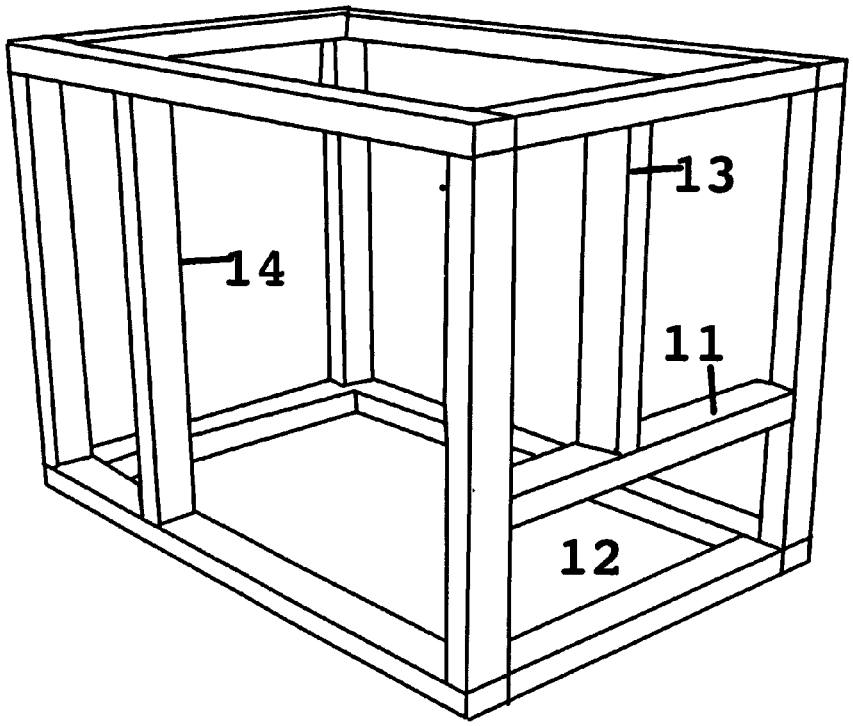
FIG. 2 is a view of the frame with horizontal and vertical members added to form the sound opening and divide two of the playing surfaces into high and low pitched panels.

The frame cajon is made by first constructing a frame as in FIG. 1. Sides 1, 2, 3, and 4 are available for attaching panels. In the preferred embodiment the horizontal and vertical members of the frame are joined with screws and glue and the members are made of a hardwood. Other joining methods may be used as well as varying materials. A hardwood provides a base for screwing panels onto the frame using flathead wood screws. The use of a structural frame allows non-structural playing surfaces to be attached on any or all sides, allowing much greater latitude in choices of playing surface material and construction. It also allows the changing of the playing surfaces without compromising the structure of the device to meet specific needs.

A horizontal member FIG. 2-11 is screwed into the frame to form the sound opening 12. This configuration allows for a shortened playing surface above the sound opening and allows the sound opening to face the audience when the shortened side is being played for greater projection of the instrument. A vertical member 13 is screwed in to divide side 1 above the sound opening 12 into a low and high-pitched panel. The larger surface creates a lower tone and the smaller surface creates a higher tone. Another vertical member 14 is screwed in to divide side 2 into a low and high-pitched panel.

Figure 3:
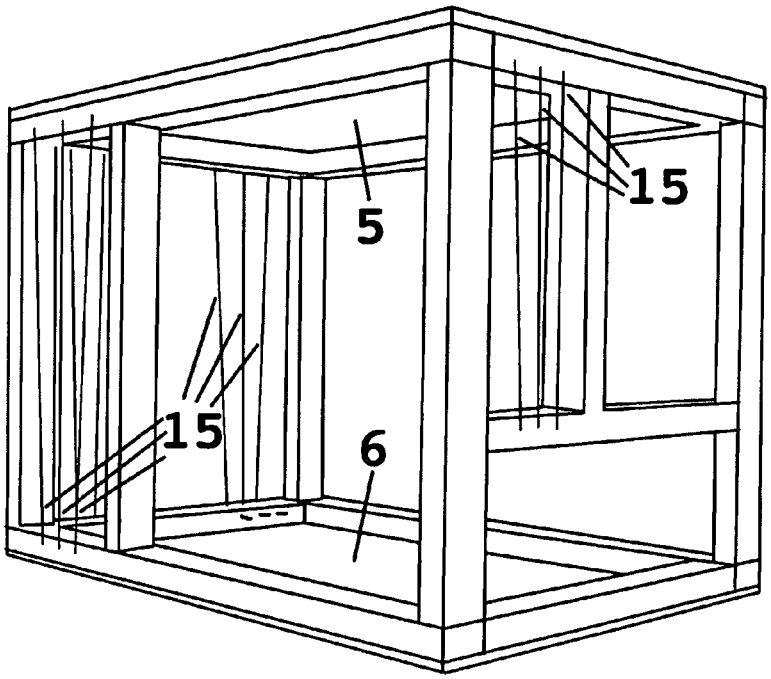
FIG. 3 is a view of the frame with a structural top and bottom panel attached along with snare wires running vertically along the outside of the frame.
Figure 4:
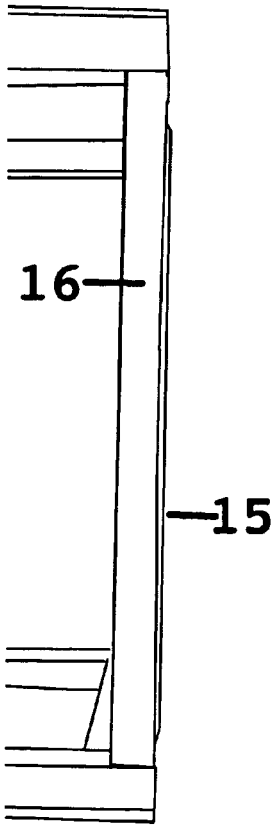
FIG. 4 is a side view of a snare bed showing a slight concave shaping of the vertical member on the side of the snare wire.
Figure 5:
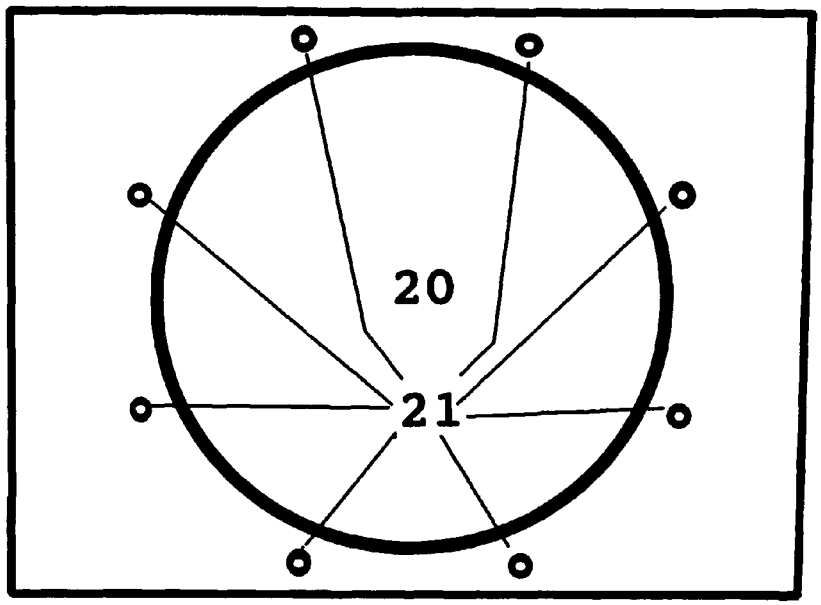
FIG. 5 is a view of the inside of the panel which mounts a sixteen inch drum head to side 4 of the cajon. It shows the tee-nuts that the rim lugs are anchored into.
Figure 6:
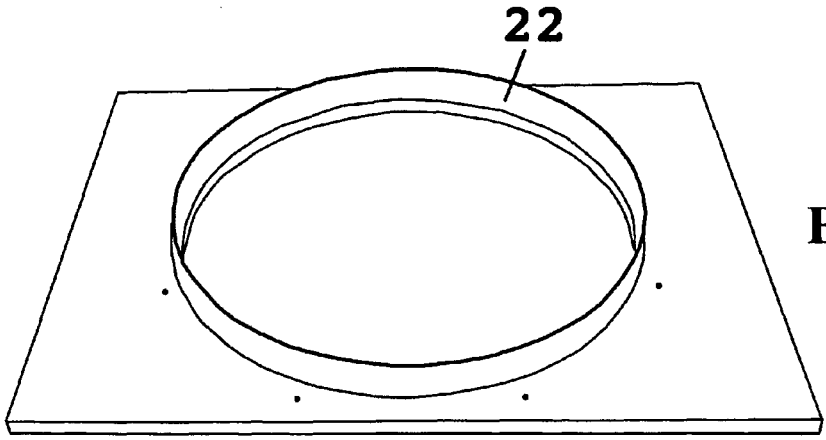
FIG. 6 is a view of the outside of the panel which mounts a sixteen inch drum head to side 4 of the cajon. It shows a sixteen inch hoop centered and glued around a fifteen inch hole.
Figure 7:
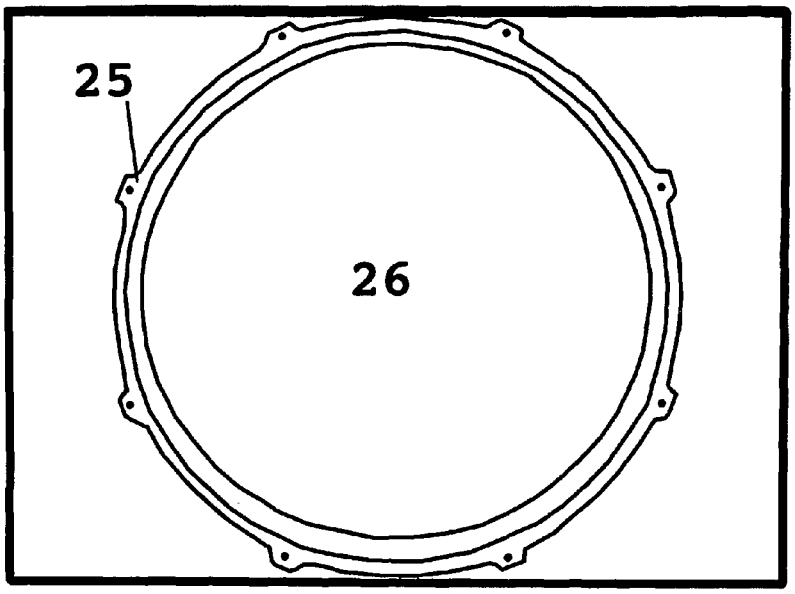
FIG. 7 is a view of the outside panel attached to side 4 of the cajon. It shows a sixteen inch drum head mounted on the hoop with a rim and lugs screwing into the tee-nuts.
Figure 8:
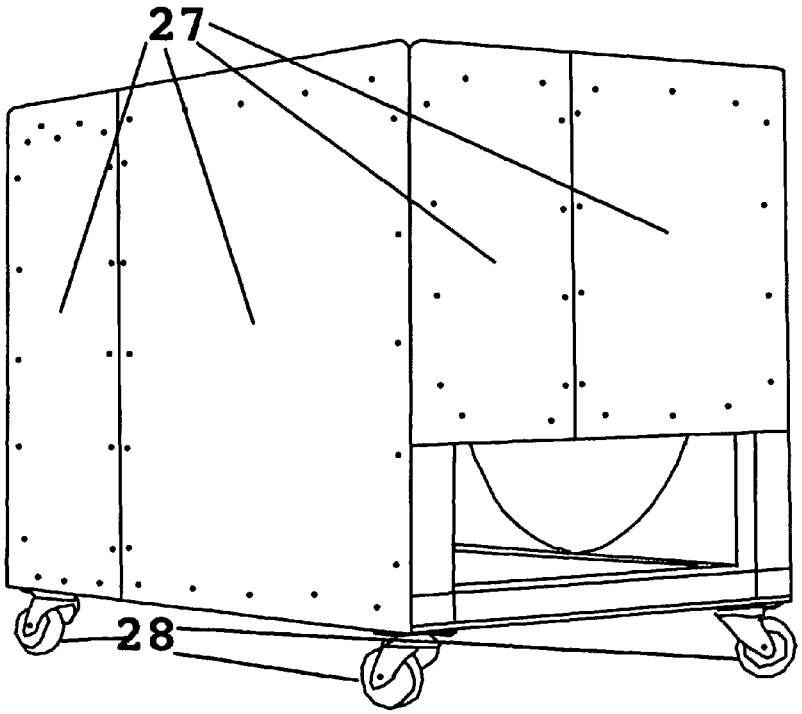
FIG. 8 is a view of a completed cajon. It shows the frame cajon with playing surfaces attached and raised up on casters.

Top FIG. 3-5 and bottom 6 structural panels are screwed and glued onto the frame. Snare wires 15 are strung vertically between top and bottom horizontal members of the frame through drilled guide holes. In the preferred embodiment, zither pins are screwed into the bottom horizontal member from inside the frame and serve to tension the strings. The vertical members on each side of the strings FIG. 4-16 are made slightly concave using a router, sander or other means. This gently curved indention to which the playing surface is fixed bends the plywood to slightly engage the snare strings eliminating the need to dampen the strings from the inside which would reduce their resonance. The snares are excited only when the player strikes the face against which the strings rest, due to the frame curvature.

Side 4 is used to mount a sixteen inch drum head. In the current embodiment, a piece of plywood that fits flush against side 4 of the frame is cut out. A fifteen inch diameter hole FIG. 5-20 in the middle of the side is cut. In the current embodiment, eight holes are drilled precisely aligned with the eight lug holes on the rim. Tee-nuts 21 are inserted from the back of the surface to serve as receivers for the lugs. A sixteen inch hoop FIG. 6-22 is glued onto the outside of the plywood centering it on the fifteen inch hole FIG. 5-20. In the current embodiment, the hoop is one and a half inches high, but this distance may be varied. Lugs are used to install and tighten a sixteen inch rim FIG. 7-25 over a sixteen inch drum head 26. The prepared drum head surface is mounted onto the frame along with the other playing surfaces FIG. 8-27 The drum head provides overall resonance for the cajon, an ability to tune the cajon, and an additional playing surface. The drum head improves overall sensitivity and bounce back of all the playing surfaces.

Risers FIG. 8-28 on the four bottom corners of the cajon are installed. In the current embodiment, casters are used to raise the cajon a minimum of 2.5". This results in an acoustic decoupling of the resonant surfaces from the floor reducing low frequency response to improve tone and clarity.

The invention claimed is:

1. A cajon drum which comprises a sound opening configuration whereby a rectangular sound hole is located below a shortened playing surface, said cajon drum further comprises a round tunable drum head attached to said a side of cajon for playing, adding resonance, and tuning said cajon.

2. A cajon snare damping system which comprises a slight concave shaping of a frame to which a playing surface is attached such that a snare effect produced by a plurality of guitar strings extending parallel to one another miming vertically on the inside of said playing surface is activated when said playing surface is struck but dampened when said playing surface is at rest eliminating the need for additional snare dampening techniques.

3. A cajon drum which comprises a cuboid structural frame that bears all the weight of a player and allows non-structural playing surfaces to be attached on all sides, said cajon drum further comprises a sound opening configuration whereby a rectangular sound hole is located below a shortened playing surface.

* * * * *